United States Patent [19]

Loos

[11] Patent Number: 4,945,702

[45] Date of Patent: Aug. 7, 1990

[54] OBSERVABLE CORNER CONNECTION

[75] Inventor: Horst Loos, Freudenberg, Fed. Rep. of Germany

[73] Assignee: Siegenia-Frank KG, Siegen, Fed. Rep. of Germany

[21] Appl. No.: 239,108

[22] Filed: Aug. 31, 1988

[30] Foreign Application Priority Data

Sep. 2, 1987 [DE] Fed. Rep. of Germany ..... 3729114

[51] Int. Cl.[5] ..... E04C 2/38

[52] U.S. Cl. ..... 52/656; 403/231

[58] Field of Search ..... 52/581, 631, 656; 248/262, 222.2; 403/245, 246, 231

[56] References Cited

U.S. PATENT DOCUMENTS

| | | | |
|---|---|---|---|
| 3,603,628 | 9/1971 | Smith | 403/245 X |
| 4,197,952 | 4/1980 | DeFouw et al. | 403/231 X |
| 4,308,692 | 1/1982 | Rumble et al. | 403/231 X |
| 4,352,433 | 10/1982 | Ford | 248/262 X |
| 4,513,554 | 4/1985 | Johnson et al. | 403/231 X |

FOREIGN PATENT DOCUMENTS

| | | | |
|---|---|---|---|
| 2327086 | 12/1974 | Fed. Rep. of Germany . | |
| 2398168 | 3/1979 | France | 52/656 |

*Primary Examiner*—David A. Scherbel
*Assistant Examiner*—Creighton Smith
*Attorney, Agent, or Firm*—Norman S. Blodgett; Gerry A. Blodgett

[57] ABSTRACT

A 3-dimensional locking cover rail corner connection between two component part of a connecting rod fitting which are mounted substantially at a right angle to one another at the closure member or the frame of a window or a door. The longitudinal edges of the cover rail portions of the component parts are braceable against the groove steps of a connecting rod groove in the closure member or frame of the window or door and are fixed within the groove by screws which extend transverse to the planes of the component parts and penetrate into the bottom of the groove. One of the cover rails has a supporting stop which projects inwardly at a right angle from the rail and a pocket beneath the stop having a spacing which corresponds to the thickness of the other cover rail. A bracket as fixed to the inner side of the one cover rail. A hook is fixed to the outer end of the bracket and projects inwardly beyond the supporting stop, the hook having a free end which faces the other cover rail. An abutment stop faces the supporting stop and is spaced from the supporting stop by a distance which is substantially equal to the thickness of the other cover rail. The other cover rail has an opening near the end which is adjacent the one cover rail for receiving the free end of the hook.

8 Claims, 3 Drawing Sheets

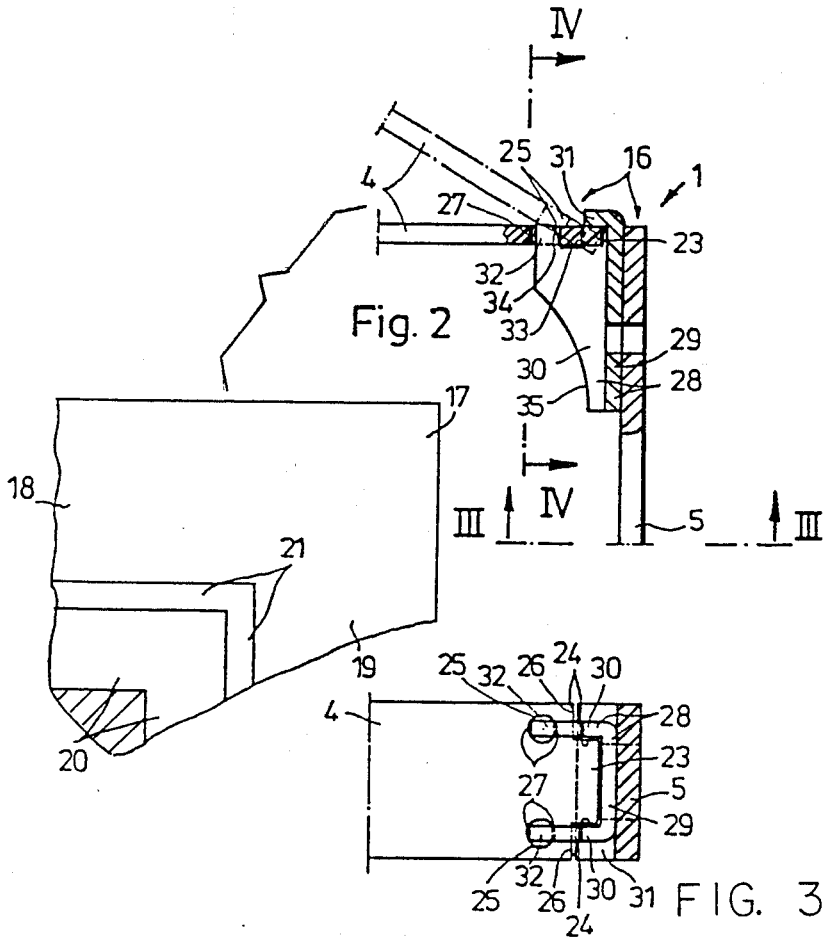
Fig. 2
FIG. 3
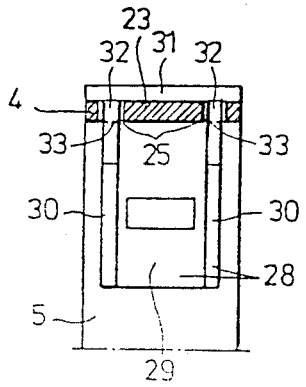
Fig. 4

OBSERVABLE CORNER CONNECTION

BACKGROUND OF THE INVENTION

The invention relates to a cover rail corner connection between two fitting components of a connecting rod fitting which are mounted substantially at a right angle to each other within a groove in either the closure member or the frame of a window or door. Each fitting component includes a cover rail which has an inner side which faces the groove, an outer side which faces away from the groove and longitudinal edges which are braceable against the shallow edge portions or the steps of the groove. The cover rails are fastened by means of screws which extend transverse to the planes of the rails and penetrate into the bottom of the groove. Hooks are provided at the ends of the cover rails which have flanks which are directed parallel as well as transverse to the plane of the cover rail. The free ends of the hooks can be brought claw-like into a mutually positive locking engagement for connecting the rails together. The hook at one end of one cover rail engages a pocket which is directed essentially transversely to the longitudinal plane of the cover rail and is shaped like a saw-tooth. A supporting stop is positioned opposite to the hook and a pocket which is formed, in part, by the supporting stop and which has a spacing that corresponds to the thickness of the other cover rail. An eyelet is located at the end of the other cover rail which can be inserted along the hook and the opposite supporting stop into the pocket so that it can register positively in the hook through limited rotation of its opening.

A cover rail corner connection of this kind is shown in the German publication DE-OS 2 327 086 (FIGS. 1 and 2). Although it is possible to interconnect the two cover rails in the corner area of the closure member or frame of a door or window, these two parts can no longer become detached from one another prior to their mounting at the closure member or frame.

It is, however, also advantageous that the engagement of the hook ends of the cover rails be brought about simply and reliably. Presently, the ends of the two cover rails which are coupled with one another are first plugged together at an obtuse angle. The engagement is then secured when both cover rails are brought into an angular position of about 90° through rotation or swinging of the cover rails relative to one another.

Another deficiency of the known cover rail corner connection is that the engagement areas of the two fitting components become covered at the preliminary stage of engagement when the cover rails are at an obtuse angle. The engagement of the hook and opening with one another cannot be observed when the two cover rails are rotated to an angular position of about 90° with respect to each other.

Therefore, the principle object of the invention is to provide an improved cover rail corner connection of the type described above having structurally simple means so that the orderly interaction of all functional parts can be constantly observed during the execution of the coupling process while insuring that the hooks standing in a reciprocal, claw-like form-locking engagement lie in, at least for the major part, the cross-sectional area of the connecting rod groove during the installation of the connecting rod fitting in the closure member or frame.

The principle object of the invention is achieved by a cover rail corner connection which includes a hook which extends from a bracket which project from the rear of one cover rail beyond the supporting stop, and an abutment stop which is located between the hook and the one cover rail which faces the supporting stop and is spaced from the supporting stop by a distance which is substantially equal to the thickness of the other cover rail.

Through the interaction of the hook and opening on the one side, as well as the supporting stop and abutment stop on the other side, it is insured that the connecting means between the cover rails can be brought into secure engagement with one another without any problem and that, without the joint use of additional fitting elements, the cover rails can no longer become inadvertantly detached prior to their mounting at the closure member or frame of a window or door.

Another advantageous feature of the cover rail corner connection of the present invention is that the abutment stop projects beyond the supporting stop.

The invention provides further that the free end of the hook reaches at least approximately up to the plane of the supporting stop. In some cases, however, it proves advantageous even when the free end of the hook protrudes beyond the plane of the supporting stop.

While in the simplest case, the bracket which bears the hook and the abutment can be constructed as a web or a plate which stands out from the one cover rail. The bracket can have a U-shaped cross-section in which the spacing between the outer surfaces of the two parallel legs of the bracket is equal to the width of the narrow groove step of the connecting rod groove, and each of the legs carries at its end, which faces the supporting stop, both a hook and an abutment stop.

Through this double arrangement of hooks and abutment stops, the stability of the cover rail corner connection is optimized in the simplest manner.

While it is within the scope of the present invention to set off the supporting stop from the cover rails themselves which carry the hooks or the abutment stop, it is also advantageous that the supporting stop is set off from the web of the substantially U-shaped bracket. The cover rail can be prefabricated unformed along its whole length prior to the application of the bracket, thereby forming a design which is especially suitable for large scale production.

In another embodiment of the invention, the two legs of the bracket form lateral boundaries of the pocket above the supporting stop between which can be inserted the other cover rail which has an offset tongue and at the openings for the engagement of the hooks are arranged in the other cover rail with a spacing behind the tongue.

In another embodiment of the invention, the openings are formed with edge coupling elements or holes in the second cover rail.

In a still further emobdiment of the invention, the tongue of the second cover rail is offset from the plane of the cover rail away from the supporting stop. In such a case, the whole cover rail corner connection lies flush within the cross-sectional profile of the connecting rod groove at the closure member or frame. One of the advantages of this embodiment is that there are no projecting parts in the air space between the gaps of the closure member and the frame at the cover rail corner connection.

BRIEF DESCRIPTION OF THE DRAWINGS

The character of the invention, however, may be best understood by reference to exemplified embodiments of the invention, in which:

FIG. 2 is an exploded fragmentary front elevational view of the coupled fitting components of the cover rail corner connection and the corner portion of the corresponding closure member with portions in section, FIG. 3 is a bottom plane view of the corner connection, looking in the direction of arrow III of FIG. 2, FIG. 4 is an end view of the corner connection, looking in the direction of arrow IV of FIG. 2.

DETAILED DESCRIPTION OF THE INVENTION

Figure 1:
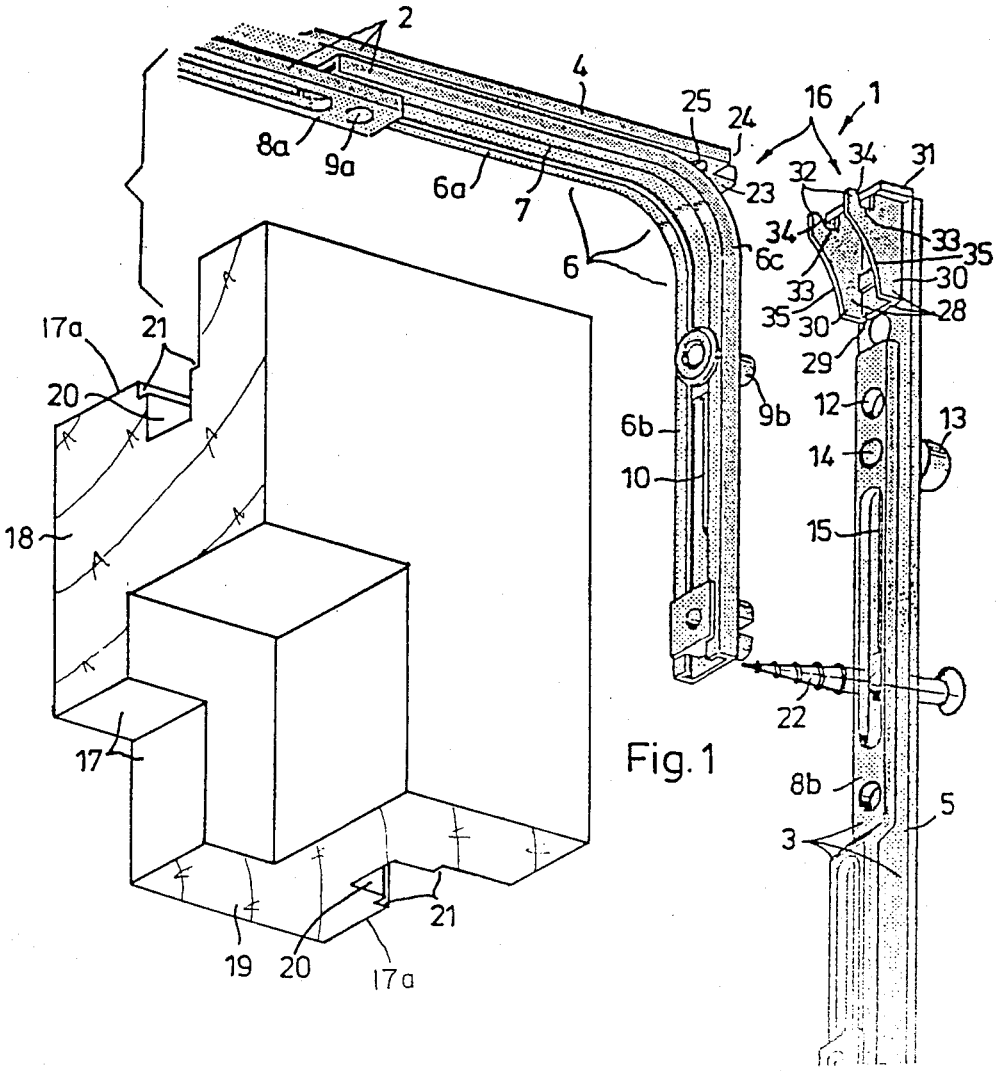
FIG. 1 is an exploded perspective view of a preferred embodiment of a cover rail corner connection showing two fitting components of a connecting rod fitting, prior to coupling and the corner portion of a conventional closure member.

Referring to FIG. 1 there is shown a connecting rod fitting, generally indicated by the reference numeral 1 for the corner area of a window or door. The corner rod fitting 1 comprises two components, 2 and 3, which fit together and which extend essentially at a right angle to one another after assembly.

The component 2 includes a cover rail 4 while the component 3 includes a cover rail 5. Preferably, both cover rails 4 and 5 consist of a metallic material, especially flat steel. The cover rails 4 and 5 are preferably fabricated of strip material with a flat rectangular cross-section.

The cover rail 4 of the component 2 is attached to a profile guide channel 6 having two straight legs 6*a* and 6*b* which extend approximately at a right angle to one another and which are connected through a curved center portion 6*c*. A flexible deflection link 7 is located in the profile guide channel 6 for lengthwise movement within the channel. The link 7 is preferably made of spring steel. The link 7 serves as the operative connection of two longitudinally movable connecting rods 8*a* and 8*b* at the inner sides of the cover rails 4 and 5, respectively.

The deflection link 7 is connected with the connecting rods 8*a* and 8*b* by means of trunions 9*a* and 9*b*, respectively, as can be clearly seen in FIG. 1. The trunion 9*a* of the connecting rod 8*a* extends through a longitudinal gap in the top leg 6*a* of the profile guide channel 6 and is fixed to the deflection link 7. The trunion 9*b* protrudes through an elongated gap 10 in the bottom leg 6*b* of the profile guide channel 6 and can be detachably coupled with a dog recess 12 in the connecting rod 8*b*.

The connecting rods 8*a* and 8*b* of the connecting rod fitting 1 form a part of the actuating mechanism for the movement of functional parts of the window or door hardware such as a locking member 13 as shown in FIG. 1 of the drawings. The locking member 13 is mounted for longitudinal movement along the outer broadside of the cover rail 5. The locking member 13 is fixed to a shaft 14 which extends through an elongated slot 15 in the cover rail 5 and is connected to the connecting rod 8*b*.

The two fitting components 2 and 3 of the connecting rod fitting 1 can be preassembled with one another via their cover rails 4 and 5 through a cover rail corner connection generally indicated by the reference numeral 16. The components, 2 and 3, are connected in a detachable manner into a functionally reliable and effective individual part of the closure member or frame of a window or door.

The construction and mode of operation of the cover rail corner connection 16 of FIG. 1 is described below in greater detail with reference to FIGS. 2 to 4 of the drawings.

Referring to FIG. 2, there is shown a frame corner of a closure member 17 or a window or a door having a horizontal leg 18 and a vertical leg 19. The closure member 17 has a peripheral surface 17*a* which has a connecting rod groove 20. The cover rail 4 will be mounted in the leg 18 and the cover rail 5 will be mounted in the vertical leg 17. One of the purposes of the cover rails 4 and 5 is to cover the corner portions of the connecting rod groove 20. The cover rails lie flush in the groove 20 and brace themselves at their two longitudinal edges on the shallow portions or steps 21 of the connecting rod groove 20. The cover rails 4 and 5 along with their components 2 and 3 are fixed to the closure member 17 in a known manner by screws 22 which penetrate through corresponding holes in the cover rails 4 and 5 and are thereby screwed into the bottom of the connecting rod groove 20.

The cover rail corner connection 16 insures that the cover rails 4 and 5 of the two components 2 and 3 are reliably fixed to each other in the direct corner area of the closure member 17, apart from the screws 22.

As part of the cover rail corner connection 16, the end of the cover rail 4 which carries the profile guide channel 6 has a tongue-like projection 23 which extends between notches 24 along the outer longitudinal edges of the cover rail as shown in FIG. 1. Openings are formed in the cover rail 4 as for example punched holes 25 which are spaced from the notches 24. The openings may also take the form of notches in the outer edges of the cover rail 4. Whether holes 25 or edge notches are used in the cover rail 4, it is important that they be spaced from the end surfaces 26 of the cover rail which form the bases of the notches 24. In the embodiment shown in FIGS. 2 and 3, each hole 25 is provided with a pair of side coupling elements which extend transversely to the plane of the cover rail 4.

A bracket 28 is fastened at the end of the cover rail 5. The bracket 28 can be formed, for example, as a punched out part of sheet metal.

The bracket 28 comprises a web wall 29 which abuts the rear side of the cover rail 5 and is connected firmly to the side of the cover rail 5 as for example through welding or riveting. A pair of parallel legs 30 extend at a right angle from the web wall 29 so that the bracket 28 is substantially U-shaped in cross-section. The distance between the outside surfaces of the two legs 30 is less than the narrow portion of the connecting rod groove 20 in the closure member 17, while the cover rail 5 fits into the steps 21 or the broader and shallower portions of the groove 20.

A flange 31 extends at a right angle to the plane of the cover rail 5 at the outer end of the bracket 28. The flange 31 has the same width as the cover rail 3 and forms a pocket with the legs 30 of the bracket 28.

Each leg 30 of the bracket 28 includes a hook 32 which extends parallel with the cover rail 5 and is transverse to the plane of the flange 31. The hooks 32 extend beyond the inner edge of the flange 31. An abutment stop 33 is parallel with the plane of the flange 31 between the hook 32 and the flange 31. Each hook 32 projects beyond its adjacent abutment stop 33 towards the plane of the flange 31 so that the free end of the hook extends to, at least substantially, the plane of the flange 31 as can be seen in FIG. 2.

The distance between the abutment stop 33 and the flange 31 is substantially equal to the thickness of the cover rail 4 so that the flange 31 forms a supporting stop for the tongue 23 of the cover rail 4.

The cover rail connection 16, is coupled by first pushing the cover rail 4 with its tongue 23 at an obtuse angle to the cover rail 5 past the hooks 32, between the legs 30 and underneath the flange 31 into the pocket of the bracket 28, as shown by the dot and dash lines in FIG. 2. The cover rails 4 and 5 are then rotated transversly to their planes into a right angled position with respect to one another to the position shown in full lines in FIG. 2. in so doing, the hooks 32 penetrate into the holes 25 of the cover rail 4 until the end of the cover rail 4 abuts the abutment stops 33. The cover rail corner connection 16 provides a form-locking coupling of the two cover rails 4 and 5. This produces a secure reciprocal position fixation of the cover rails 4 and 5 in all spacial directions prior to the insertion of connecting rod fitting 1 into the legs 18 and 19 of the connecting rod groove 20 of the-closure member 17 and the insertion of the cover rails 4 and 5 into the groove steps 21.

The edge of each hook 32 which faces the cover rail 5 or the flange 31 is curved, which facilitates the coupling of the cover rail corner connection 16. These curved edges are identified with the reference numeral 34 and are clearly shown in FIGS. 1 and 2. This forms a substantially saw-tooth contour which broadens toward the abutment stop 33. This creates an engagement which is practically without play between the coupling elements 27 of the holes 25 in the cover rail 4 as well as at the stops 33 and also at the surface of the flange 31 which forms the supporting stop in abutment with the cover rail 4.

Each leg 30 has a concavely curved inner edge 35 which faces and abuts the convexly curved outer surface of the center piece 6c of the profile guide channel 6. This provides additional support for the cover rail corner connection 16.

Figure 5:
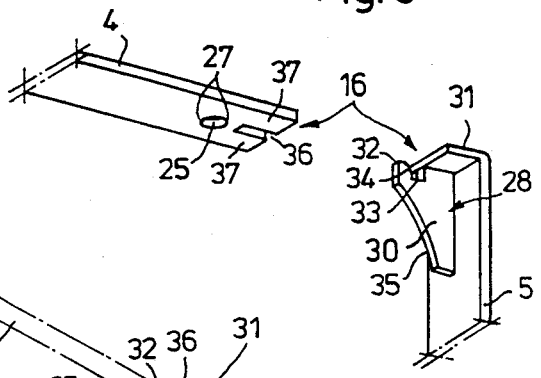
FIG. 5 is a perspective view of a modified cover rail corner connection, prior to joining of the two elements which form the connection.
Figure 5:
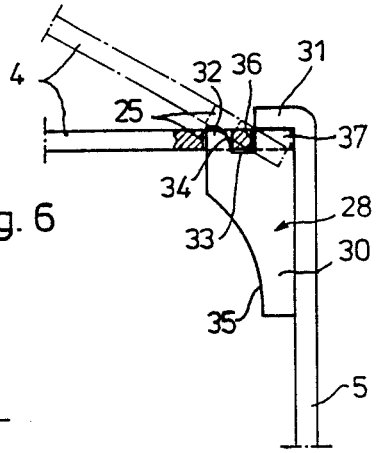
Figure 6:
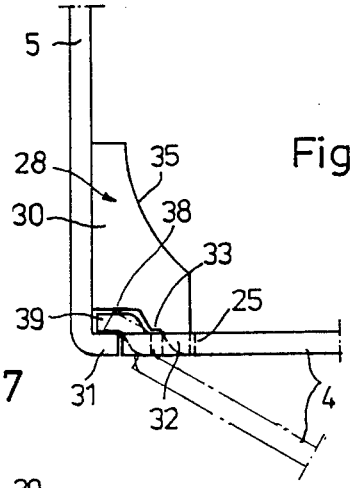
FIG. 6 is a fragmentary front elevational view of the modified cover rail corner connection of FIG. 5 with portions in section.
Figure 8:
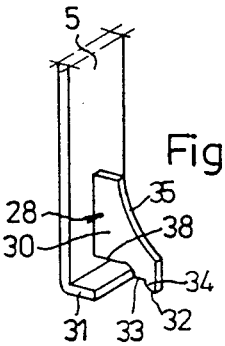
FIG. 8 is a fragmentary front elevational view of a modified corner connection of FIG. 7.
Figure 7:
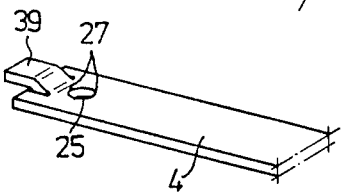
FIG. 7 is a perspective view of still another embodiment of the cover rail connection of the present invention prior to the joining of the two elements which form the connection.

Referring to FIGS. 5, 6 and also FIGS. 7 and 8 there are shown two additional embodiments of a cover rail corner connection 16. These embodiments are of a simplified design in comparison to the embodiment of FIGS. 1–4.

In both additional embodiments, the flange 31 which serves as the supporting stop for the cover rail 4 is formed as a flange from the cover rail 5.

In both cases, the bracket 28 which is connected with the cover rail 5 has only one leg 30 which is centrally located with respect to the plane of the cover rail 5 and extends at a right angle to that plane.

Referring specifically to the cover rail corner connection 16 of the embodiment shown in FIGS. 5 and 6, the bracket 28 and, specifically, its single leg, 30 has practically the same shape as each of the legs 30 of the bracket 28 of the embodiment which is shown in FIGS. 1–4.

So that the cover rail 4 of the embodiment which is shown in FIGS. 5 and 6 can be superimposed without impediment into the bracket 28 or the leg 30 on the supporting stop which is formed by the flange 31 of the cover rail 5, the cover rail 4 is provided with a central open-ended slot 36. The width of the slot 36 is substantially equal to the thickness of the leg 30. A tongue 37 is thereby formed on each side of the slot 36. The tongues 37 enter into an operative connection with the supporting stop which is formed by the inner surface of the flange 31. A hole 25 is formed in the cover rail 4 and is spaced from the slot 36. A pair of side-coupling elements are located in the hole 25 and extend transversely to the plane of the cover rail 4. The hook 32 of the leg 30 extends into the hole 25 or between the side-coupling elements 27 when the cover rail 4 swings from its dot-and-dash line position into the full line position shown in FIG. 6, wherein the cover rail 4 will be positively fixed at the brackets 28 or at the leg 30 and also at the abutment stop 33.

The cover rail corner connection 16 embodiment which is shown in FIGS. 7 and 8 is distinguished from the embodiment shown in FIGS. 5 and 6 in that when the cover rail 4 is coupled to the cover rail 5 by the corner connection 16, the flange 31 which extends at a right angle to the cover rail 5 is located in the same plane as the cover rail 4. The advantage of this is that the connecting rod fitting 1 in the area of the cover rail corner connection 16 is totally flush with the edge surface **17*a* of the closure member 17 in its connecting rod groove 20. The bracket 28 or leg 30 which constitutes the bracket 28 has an edge surface 38 which faces the flange 31 and is spaced from the flange 31 by a distance which is substantially at least equal to the thickness of the cover rail 4. The leg 30 also has an edge surface 33 which faces the cover rail 4 and constitutes the abutment stop for the bracket 28 or the leg 30. The surface 33 is substantially in the same plane as the inner surface of the flange 31 which forms the supporting stop. The surface 33 is also spaced from the free end of the flange 31 by a distance which corresponds to the thickness of the cover rail 4. The leg 30 has a hook 32 which extends toward the flange 31. The abutment stop 33 is located between the edge 38 and the hook 32**.

In the embodiment which is shown in FIGS. 7 and 8, a cover rail 4 has a similar construction to the cover rail 4 of the embodiment which is shown in FIGS. 1–4. The cover rail 4 in FIGS. 7 and 8 has a tongue 39 which is central of the cover rail 4.

However, the embodiment shown in FIGS. 7 and 8 deviates from the embodiment which is shown in FIGS. 1–4 in that the tongue 39 is offset from the plane of the cover rail 4 and is spaced from the cover rail 4 by a distance which is equal to the thickness of the flange 31 of the cover rail 5.

The cover rail corner connection 16, according to the embodiment shown in FIGS. 7 and 8, is coupled by first inserting the tongue 39 between the supporting stop which is formed by the inner face of the flange 31 and the edge 38 of the bracket 20 or the leg 30 as indicated by the dot-and-dash lines in FIG. 8. The cover rail 4 is then rotated from the dot-and-dash line position to the full line position as shown in FIG. 8. This causes the hook 32 to engage the hole 25 or come between the side-coupling elements 27 of the cover rail 4 while the inner surface of the cover rail 4 strikes against the abutment stop 33.

The cover rail 4 is, thereby, in a fixed position with the tongue 39 against the supporting stop which is formed by the inner surface of the flange 31 so that the cover rail 4 assumes a flush position with respect to the flange 31, as can be clearly seen from FIG. 8.

Referring to the cover rail corner connection 16 of the embodiments shown in FIGS. 5 and 6, or the embodiments which is shown in FIGS. 7 and 8, there is achieved a 3-dimensional form-locking coupling connection between the cover rails 4 and 5 prior to the insertion of the whole connection rod fitting 1 into the connecting rod groove 20 of the closure members 17.

As a further modification to the cover rail corner connection 16 of the embodiments shown in FIGS. 1–4, it is possible to offset the tongue 23 of the cover rail 4 away from its outer surface by the thickness of the flange 31 of the bracket 28 so that the outer surface of the cover rail 4 and the outer surface of the flange 31 are to be in a flush position in the coupled state.

Clearly, minor changes may be made in the form and construction of the invention without departing from the material spirit of either. Therefore, it is not desired to confine the invention to the exact forms shown herein and described, but it is desired to include all subject matter that properly comes within the scope claimed.

The invention having been thus described, what is claimed as new and desired to secure by Letters Patent is:

1. A cover rail corner connection between two fitting components of a connecting rod fitting which are mounted substantially at a right angle to each other within a groove in a closure member, each fitting part having an inner side which faces the groove, an outer side which faces away from the groove and a cover rail which has longitudinal edges which are braceable against the steps of the groove, each fitting component being fastened within the groove by screws, the end of one of the cover rails having a supporting stop which projects inwardly from the rail and a pocket beneath the stop having a spacing which corresponds to the thickness of the other cover rail, said cover rail corner connection comprising:

a bracket (28, 30) which is fixed to the inner side of one of the cover rails (5), a hook (32) which is fixed to the outer end of the bracket (28,30) and which projects inwardly beyond the supporting stop (31) said hook having a free end which faces the other of said cover rails (4), an abutment stop (33) which faces said supporting stop (31) and is spaced from said supporting stop by a distance which is substantially equal to the thickness of the other of said cover rails (4), and an opening in the outer end of the other of said cover rails (4) for receiving the free end of said hook (32).

2. A cover rail corner connection as recited in claim 1, wherein the abutment stop (33) also protrudes beyond the supporting stop (31).

3. A cover-rail corner connection as recited in claim 1, wherein the free end of the hook (32) extends at least substantially to the plane of the supporting stop (31).

4. A cover-rail corner connection as recited in claim 1, wherein the groove of the closure member has a shallow step (21) on each side of the groove, the bracket (28) is substantially u-shaped in cross-section and includes a web (29) and two parallel legs (39), each with a hook (31), the distance between the two external surfaces of the two parallel legs (30) is substantially equal to the width of the narrow groove step of the connecting rod groove (20), and, wherein each one of the legs (30) carries at its end which faces the supporting stop (31) both as hook (32) and an abutment stop (33) and, wherein the other of said cover rails has two holes (25) for receiving the two hooks (31).

5. A cover rail corner connection as recited in claim 4, wherein the supporting stop (31) is part of the bracket (28) and is angularly offset from the web (29) of the substantially U-shaped bracket (28).

6. A cover rail corner connection as recited in claim 4, wherein the two legs (30) of the bracket (28) form with the supporting stop (31) lateral boundaries of the pocket into which can be inserted an offset tongue (23) of the other cover rail (4) and at the holes (25) for the engagement of the hooks (32) in said other cover rail (4) are spaced inwardly from the tongue (23).

7. A cover rail corner connection as recited in claim 1, wherein the opening is a hole (25) in said second cover rail (4).

8. A cover rail corner connection as recited in claim 1, wherein the second cover rail (4) has a tongue (39) which is offset from the plane of the cover rail away from the supporting stop by the thickness of the supporting stop (31) at said one cover rail (5) and at the other surface of said other cover rail (4) lies flush with the external surface of the supporting stop (31).

* * * * *